United States Patent [19]

Williams

[11] 4,444,161

[45] Apr. 24, 1984

[54] ROTARY VALVE FOR INHERENTLY BALANCED ENGINE

[76] Inventor: Thomas V. Williams, 2901 W. Cheltenham, Philadelphia, Pa. 19150

[21] Appl. No.: 338,207

[22] Filed: Jan. 11, 1982

Related U.S. Application Data

[63] Continuation-in-part of Ser. No. 132,606, Mar. 21, 1980, Pat. No. 4,392,460.

[51] Int. Cl.[3] ..... F01L 7/00

[52] U.S. Cl. ..... 123/190 E; 123/80 BB; 123/41.4; 123/190 BA

[58] Field of Search ..... 123/41.4, 80 R, 80 BB, 123/190 R, 190 B, 190 BA, 190 E

[56] References Cited

U.S. PATENT DOCUMENTS

| | | | |
|---|---|---|---|
| 1,190,363 | 7/1916 | Anderson | 123/190 BA |
| 1,364,065 | 1/1921 | Asbury | 123/190 BA |
| 1,594,430 | 8/1926 | Thomas | 123/190 BA |
| 1,626,111 | 4/1927 | Barker | 123/41.4 |
| 1,720,206 | 7/1929 | Carlson | 123/41.4 |
| 2,004,912 | 6/1935 | Heinel | 123/190 BA |
| 2,018,975 | 10/1935 | Schutzniedrig | 123/56 A |
| 2,156,202 | 4/1939 | Spencer | 123/56 AA |
| 3,043,283 | 7/1962 | Vitale | 123/56 A |
| 4,010,727 | 3/1977 | Cross et al. | 123/190 B |
| 4,019,487 | 4/1977 | Guenther | 123/190 E |
| 4,279,225 | 7/1981 | Kersten | 123/190 BA |

FOREIGN PATENT DOCUMENTS

| | | | |
|---|---|---|---|
| 719619 | 4/1942 | Fed. Rep. of Germany . | |
| 19455 | of 1912 | United Kingdom | 123/190 BA |

*Primary Examiner*—Craig R. Feinberg
*Assistant Examiner*—W. R. Wolfe
*Attorney, Agent, or Firm*—Spivak, Karl L.

[57] ABSTRACT

A rotary valve for an internal combustion engine of the type having at least two banks of oppositely disposed cylinders to conduct an air-fuel mixture into one cylinder and to simultaneously dispose of the exhaust gases from a second cylinder. The rotary valve can be provided with coolant passages and is synchronized for rotation with the crank shaft of the engine to time the inlet and exhaust gases to and from the cylinders. The engine can be built in any number of cylinders, but the four cylinder and eight cylinder combination provides the most compact engine design.

17 Claims, 28 Drawing Figures

FIG. 18
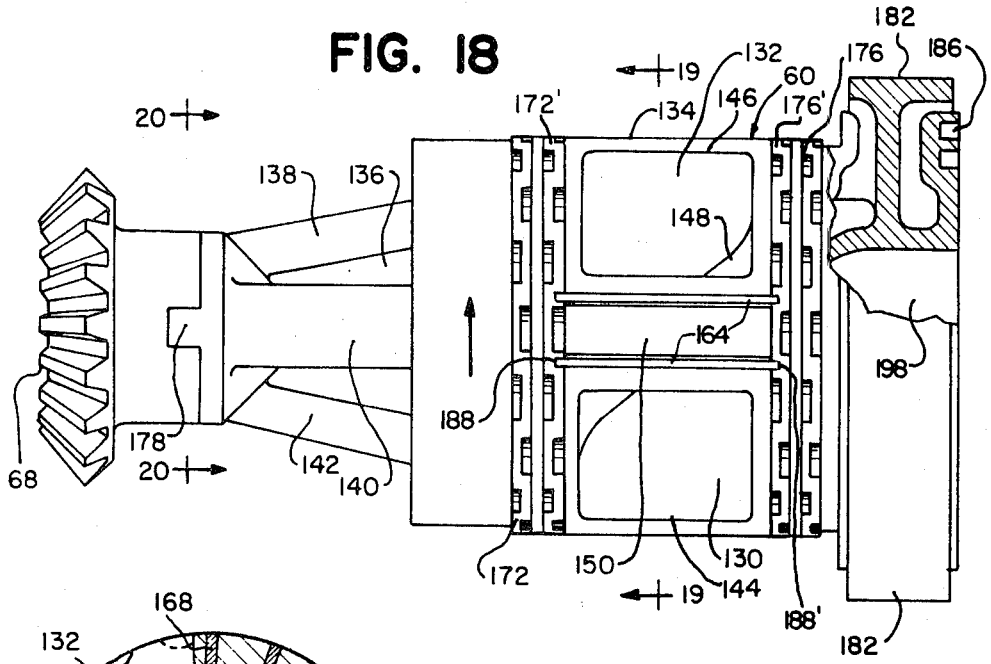
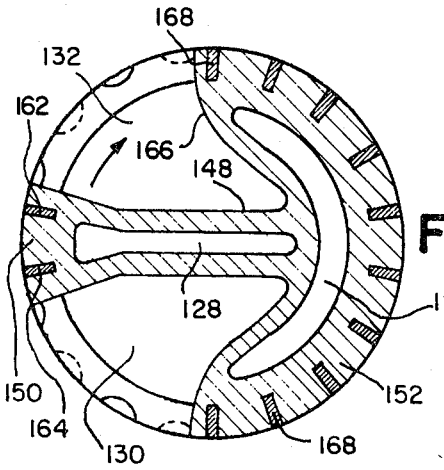
FIG. 19
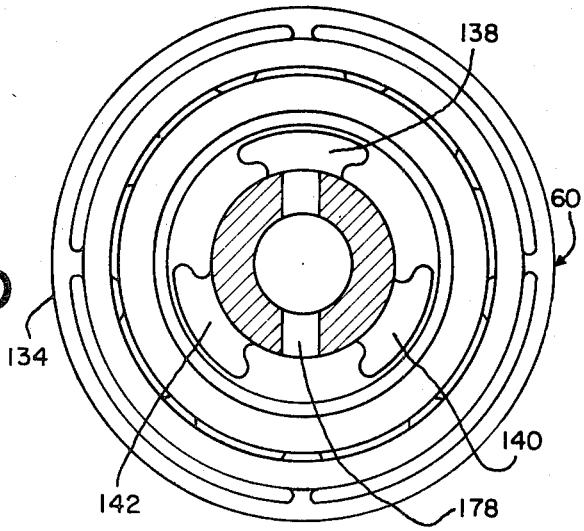
FIG. 20

ROTARY VALVE FOR INHERENTLY BALANCED ENGINE

RELATED APPLICATION

This application is a continuation-in-part of my co-pending application entitled "Parallel Inherently Balanced Rotary Valve Internal Combustion Engine", filed Mar. 21, 1980, Ser. No. 132,606, now U.S. Pat. No. 4,392,460.

BACKGROUND OF THE INVENTION

The present invention relates generally to the field of internal combustion engines, and more particularly, is directed to rotary valves for use generally in a four cylinder internal combustion engine or in an eight cylinder inherently balanced internal combustion engine of the type disclosed in the said co-pending application, now U.S. Pat. No. 4,392,460.

The engine using the rotary valve of the present invention can be built in any number of cylinders, but the four cylinder and eight cylinder combinations appear most practical at this time for developing adequate power in a compact design. Either a gaseous fuel or a diesel fuel may be employed with the same rotary valve design and with but minor engine modifications. It is therefore possible to operate one bank of four cylinders as a diesel engine and to utilize a second bank as a gaseous engine, for example for starting purposes or for optional extra power. The following description is directed particularly to an eight cylinder engine for purposes of illustration inasmuch as a four cylinder engine would need rotating counterweights and other odd number of cylinder engines are not inherently balanced.

SUMMARY OF THE INVENTION

The present invention is directed generally to the field of internal combustion engines of the type suitable for use either with gaseous fuel or with diesel fuel, and more particularly, is directed to a rotary valve for each bank of cylinders of an internal combustion engine comprising one or more banks of cylinders for directing flow into and out of the cylinders.

The rotary valve includes circularly offset fuel-air and exhaust gas passages and may be provided with an axial flow path for coolant flow. A means to synchronize valve rotation with the rotation of the engine crankshaft or crankshafts is also included. In the case of the use of the rotary valve with a diesel engine, an exhaust port liner could be employed for valve and seal protection purposes. In the preferred embodiment, each rotary valve is equipped with a plurality of axially aligned, circularly offset combustion seals, which seals axially extend intermediate a pair of longitudinally spaced, circular, combustion seal rings. The axially aligned combustion seals and the spaced circular combustion seal rings cooperate to provide improved combustion sealing in all rotated positions of the rotary valve.

In the preferred embodiment, the rotary valve is positively driven through bevel gears and is synchronized for revolution at one-half engine speed for a four cycle engine. The rotary valve has its axis of rotation about a line that is parallel with the central axes of the four cylinders forming the bank of cylinders. The four cylinders of the bank are equally spaced, are positioned ninety circular degrees apart with respect to the rotary valve and the axis of rotation of the rotary valve is equidistant from the central axis of each cylinder in the bank. One rotary valve services each of the four cylinders in each cylinder bank and includes an intake port for introduction of air for diesel or gaseous fuel operation and an exhaust port to direct the spent gases from the cylinders. The intake and exhaust ports are angularly offset and are positioned to feed a fuel-air mixture sequentially and consecutively into a respective port of each cylinder and to simultaneously accept the respective exhausts from the ports of the cylinders in the bank, also sequentially and consecutively.

The fuel-air and exhaust passages of the rotary valve include peripheral openings which are designed to provide rotative, sequential alignment with the port opening of each cylinder in the bank. The fuel-air passage peripheral opening feeds a suitable air-fuel mixture from the fuel-air passage within the valve to the port opening of a first cylinder while simultaneously, the exhaust passage peripheral opening sequentially accepts the exhaust gases from a second cylinder port opening for flow through the valve exhaust passage and then outwardly from the engine. The rotary valve includes a plurality of circular seals and a plurality of longitudinal seals for optimum engine sealing while the valve is rotated.

In a preferred embodiment of an eight cylinder engine, as hereinafter more fully described, two banks comprising four cylinders each are oppositely disposed and adjacently arranged. The pistons of two cylinders of each bank are connected to a first, common crankshaft. The pistons of the remaining two cylinders of each bank are connected to a second, common crankshaft. The first and second crankshafts are disposed in side by side relationship and are timed together for synchronized rotation. Each bank of four cylinders includes a single rotary valve, both to supply the air-fuel mixture to the cylinders and to dispose of the exhaust gases from the cylinders. Each rotary valve is synchronized to function with a suitable fuel injector or other fuel supply source of known design.

It is therefore an object of the present invention to provide an improved rotary valve for use in an internal combustion engine of the type set forth.

It is another object of the present invention to provide a novel rotary valve for use in an internal combustion engine wherein the valve includes fuel inlet and exhaust gas outlet means to control the function of a bank of cylinders.

It is another object of the present invention to provide a novel rotary valve for an internal combustion engine that includes improved valve sealing means.

It is another object of the present invention to provide a novel rotary valve for an internal combustion engine having an air-fuel mixture opening for feeding the mixture into the port opening of a first cylinder, an exhaust gas opening for accepting simultaneously the exhaust gases from the port opening of a second cylinder and sealing means to isolate the port openings of adjacent cylinders as the valve is rotated.

It is another object of the present invention to provide a novel rotary valve for an internal combustion engine having an air-fuel feed opening and the exhaust gas accepting opening, the air-fuel feed opening and the exhaust gas opening being adapted for sequential alignment with the port openings of a plurality of cylinders, the rotary valve openings being larger in circular dimension than the associated port openings of each of the plurality of cylinders in order to accommodate the gas flow to and from the cylinder.

It is another object of the present invention to provide a novel rotary valve for an internal combustion engine comprising an air-fuel passage, and exhaust gas passage, a plurality of longitudinally aligned seals and a plurality of circular, longitudinally spaced seals for optimum sealing as the valve is rotated.

It is another object of the present invention to provide a novel rotary valve for an internal combustion engine that is simple in design, rugged in construction and trouble free when in use.

Other objects and a fuller understanding of the invention will be had by referring to the following description and claims of a preferred embodiment, taken in conjunction with the accompanying drawings, wherein like reference characters refer to similar parts throughout the several views and in which:

BRIEF DESCRIPTION OF THE DRAWINGS

FIG. 18 is a side elevational view of the rotary valve, partially broken away to expose interior construction features.

FIG. 19 is a cross sectional view taken along line 19—19 on FIG. 18 looking in the direction of the arrows.

FIG. 20 is a cross sectional view taken along line 20—20 on FIG. 18, looking in the direction of the arrows.

DESCRIPTION OF THE PREFERRED EMBODIMENT OF THE INVENTION

Figures 1, 2:
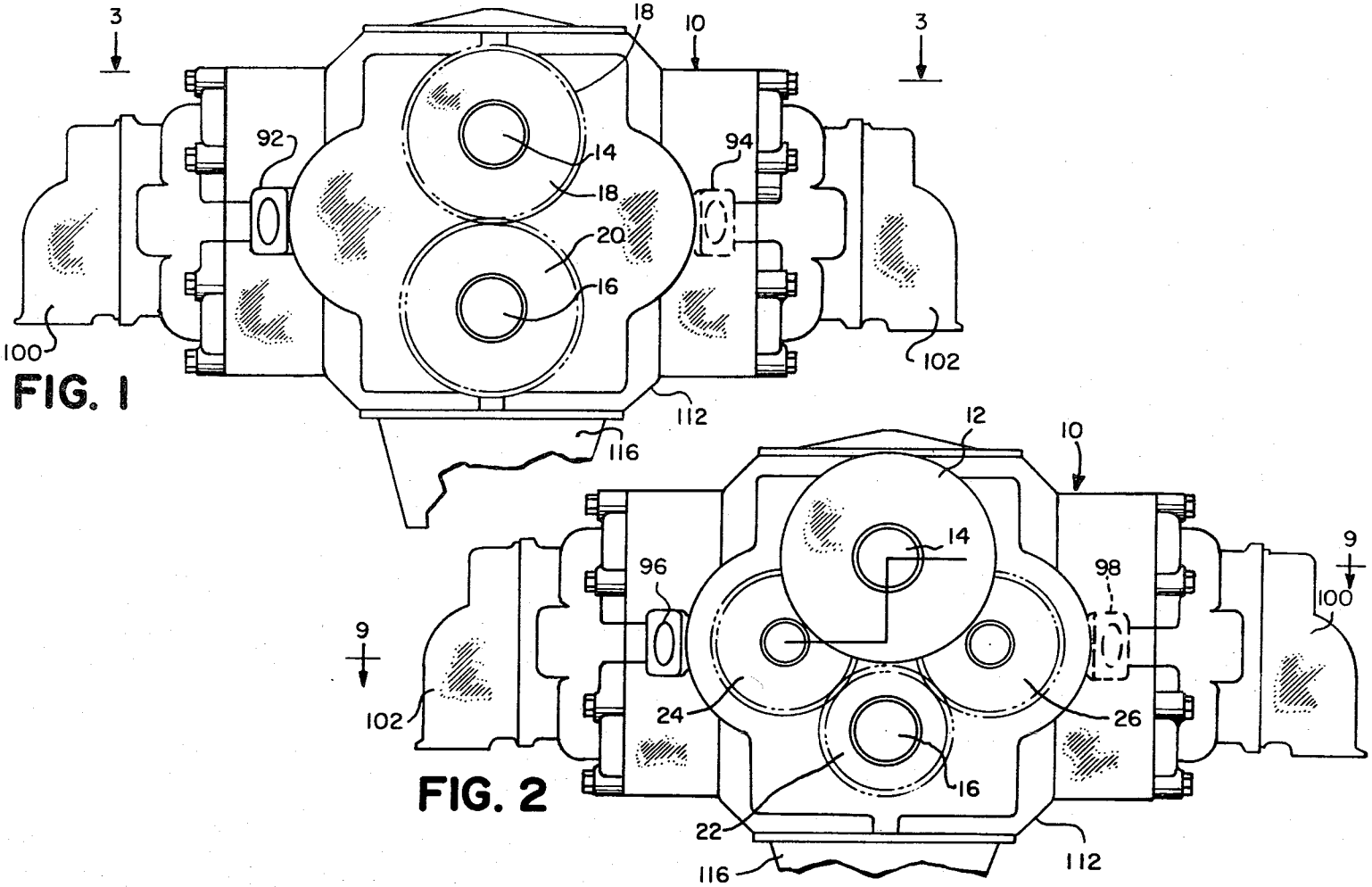
FIG. 1 is a front elevational view of an internal combustion engine equipped with a rotary valve in accordance with the present invention.
FIG. 2 is rear elevational view of the engine of FIG. 1.
Figure 3:
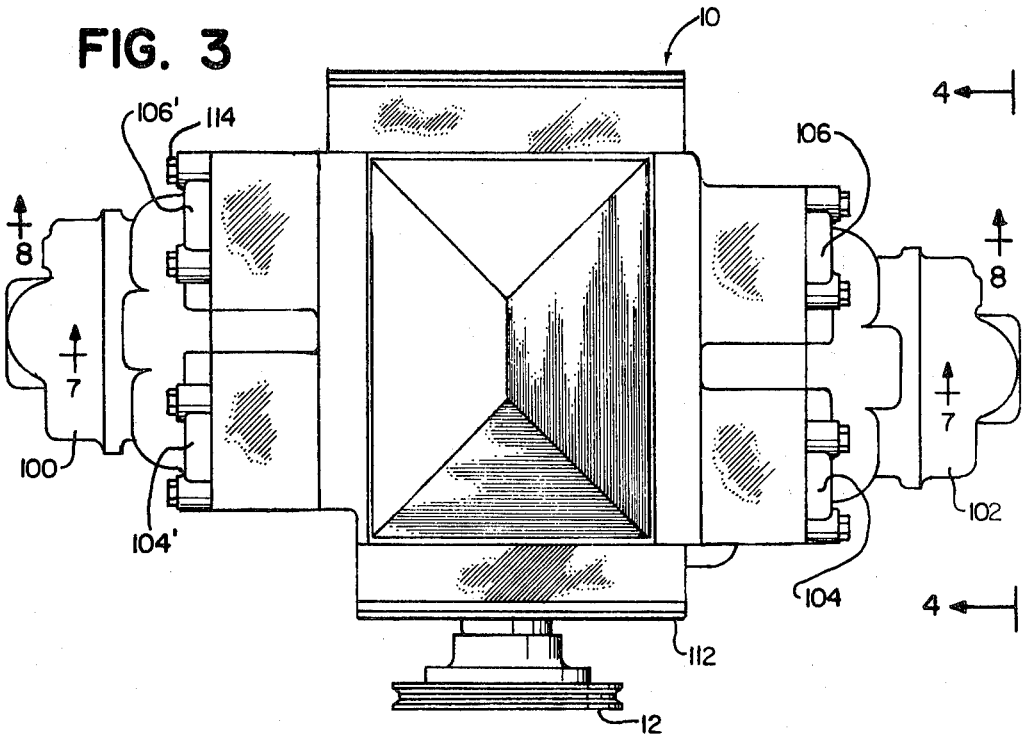
FIG. 3 is a top plan view of the engine of FIG. 1, looking from line 3—3 on FIG. 1.
Figure 4:
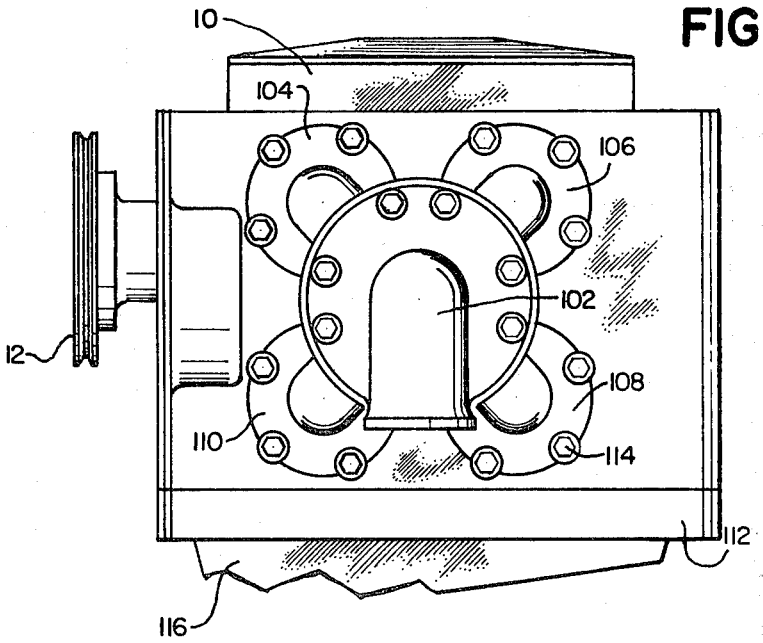
FIG. 4 is an end elevational view, looking from line 4—4 on FIG. 3.

Although specific terms are used in the following description for the sake of clarity, these terms are intended to refer only to the particular structure of the invention selected for illustration in the drawings, and are not intended to define or limit the scope of the invention.

Referring now to the drawings, there is illustrated in FIGS. 1 and 2 an internal combustion engine generally designated 10 within which a plurality of cylinders, arranged in a pair of vertically juxtaposed banks, are operatively connected as hereinafter more fully set forth. A starter motor (not shown) is exteriorly connected to a conventional flywheel 12 in a usual manner for rotation of either the upper or lower crankshaft 14 or 16 for starting purposes. An upper crankshaft gear 18 meshes with a lower crankshaft gear 20 to synchronize rotation of the upper and lower crankshafts 14, 16 in known manner. As illustrated, a valve drive gear 22 is carried at one end of the lower crankshaft 16 to rotate simultaneously the similar, horizontally juxtaposed, first and second rotary drive gears 24, 26.

Figure 5:
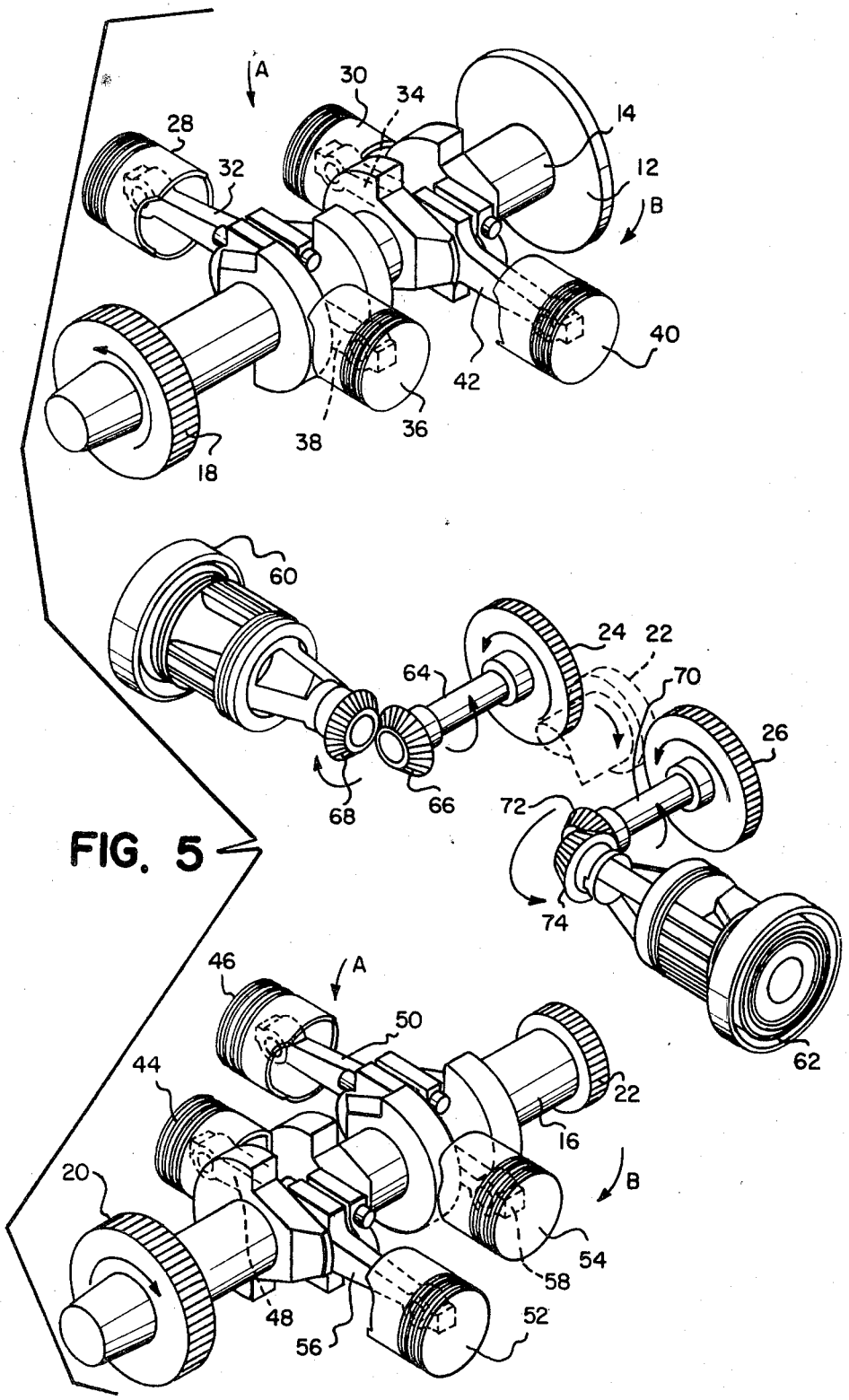
FIG. 5 is an enlarged, perspective, schematic, exploded view showing the relationship between the rotary valves, pistons and crankshafts in two banks of cylinders in an eight cylinder engine.

Referring now to FIG. 5, two upper pistons 28, 30 of a first bank A of cylinders are operatively connected to the upper crankshaft 14 through respective piston or connecting rods 32, 34. As illustrated an upper piston 36 of the right bank of cylinders B is connected to the upper crankshaft 14 at the same crank as the piston rod 32 by its associated piston rod 38. The other upper piston 40 of the right bank of cylinders B is similarly connected to the upper crankshaft 14 at the same crank as the left piston rod 34 by its associated piston rod 42. Similarly, the lower pistons 44, 46 of the left bank A connect to the lower crankshaft 16 through their respective piston rods 48, 50. The lower pistons 52, 54 of the right cylinder bank B also connect to the lower crankshaft 16 through their respective piston rods 56, 58 to provide a complete, synchronized functioning assembly comprising a left bank A of cylinders having operating pistons 28, 30, 44, 46 and a right bank B of cylinders comprising the operating pistons 36, 40, 52 and 54.

A rotary valve 60, 62 is provided for each of the cylinder banks A, B and these valves are respectively rotated in unison by the first and second rotary drive gears 24, 26. The first rotary drive gear 24 rotates a drive shaft 64 to supply positive rotative power to the first rotary valve 60 through the meshing bevel gears 66, 68. Similarly, the second rotary drive gear 26 rotates its affixed shaft 70 to rotate positively the second rotary valve 62 through meshing interaction of the bevel gears 72, 74. It will be noted that the upper and lower crankshafts 14, 16 rotate in synchronism through meshing of crankshaft gears 18, 20, causing rotation of the valve drive gear 22 which is affixed at the opposite end of the crankshaft 16. Direct or indirect meshing between the first and second rotary drive gears 24, 26 and the valve drive gear 22 synchronizes rotation of the rotary valves 60, 62. The speed of rotation of the first and second rotary valves 60, 62 can be established in known manner by varying the gear ration between the valve drive gear 22 and the first and second rotary drive gears 24, 26.

Figure 6A:
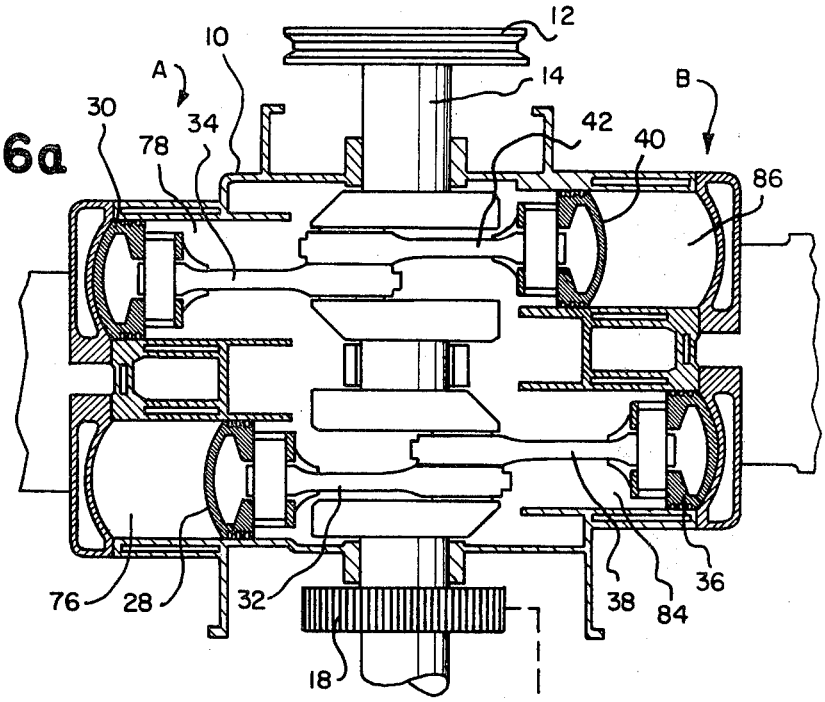
FIGS. 6*a* and 6*b* illustrate a schematic representation of the parts of FIG. 5 in association with the cylinders.
Figure 6B:
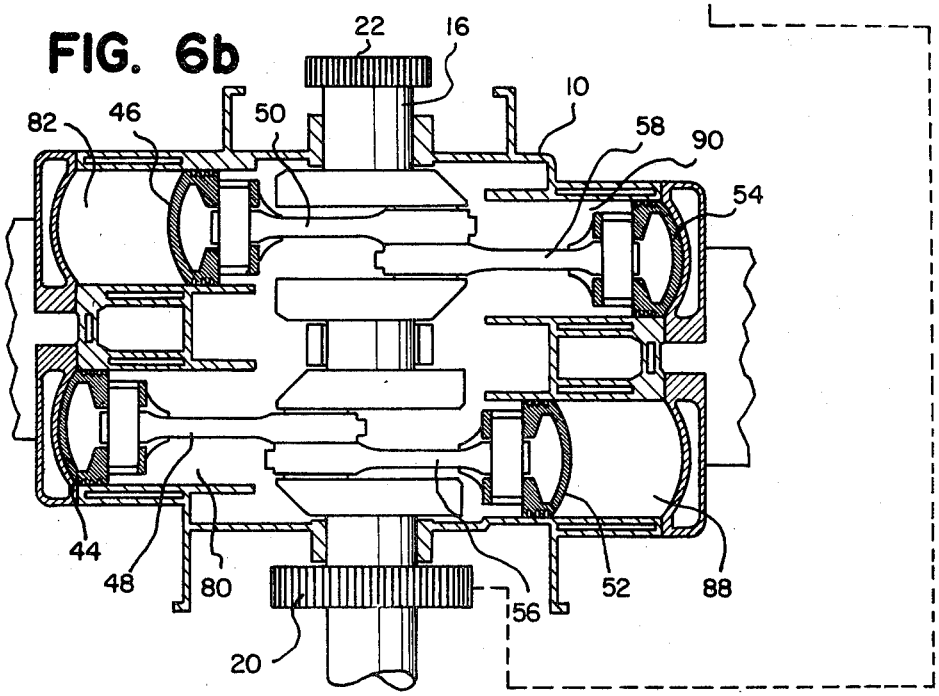
Figure 7:
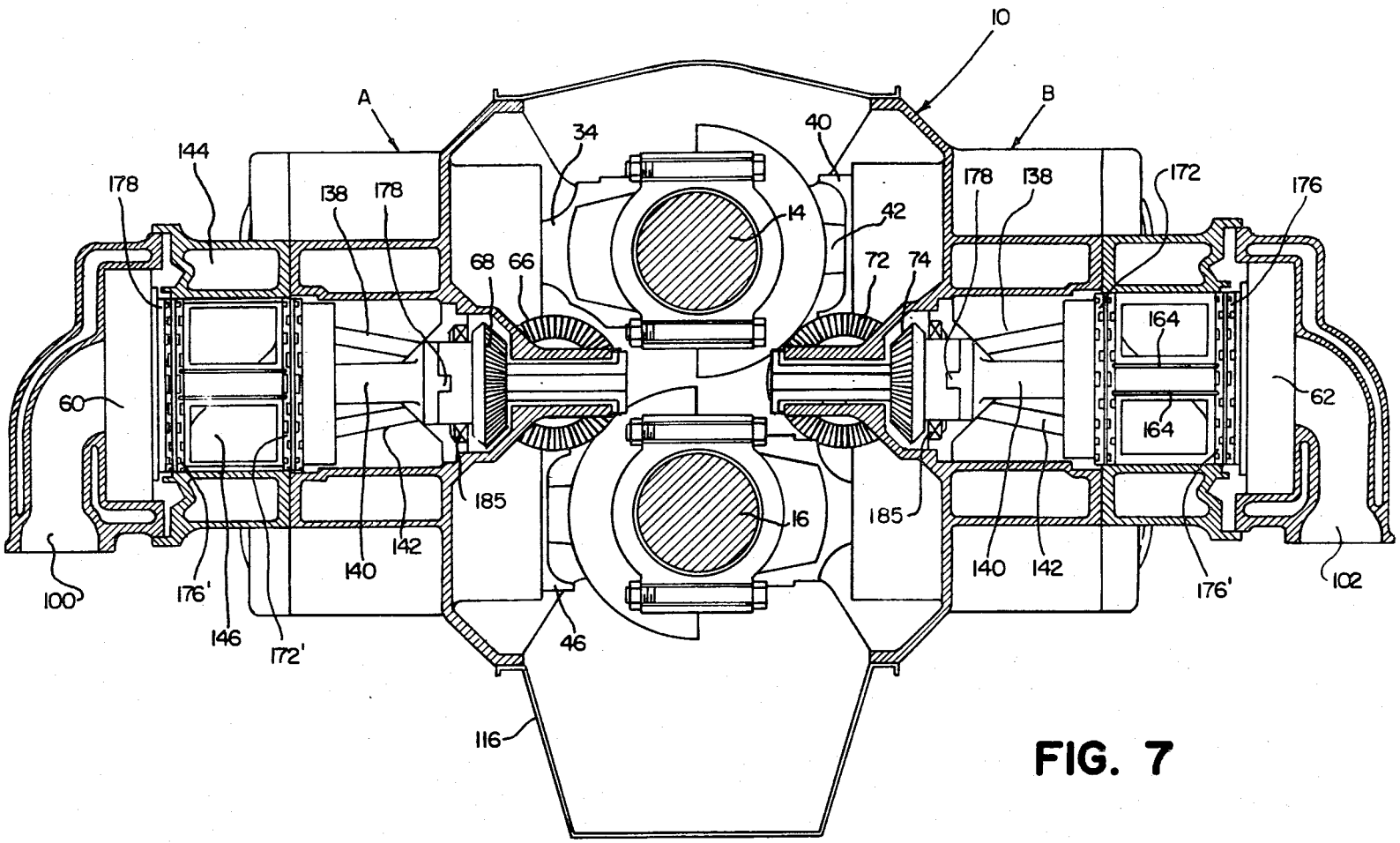
FIG. 7 is a cross sectional view, taken along line 7—7 on FIG. 3, looking in the direction of the arrows.
Figure 8:
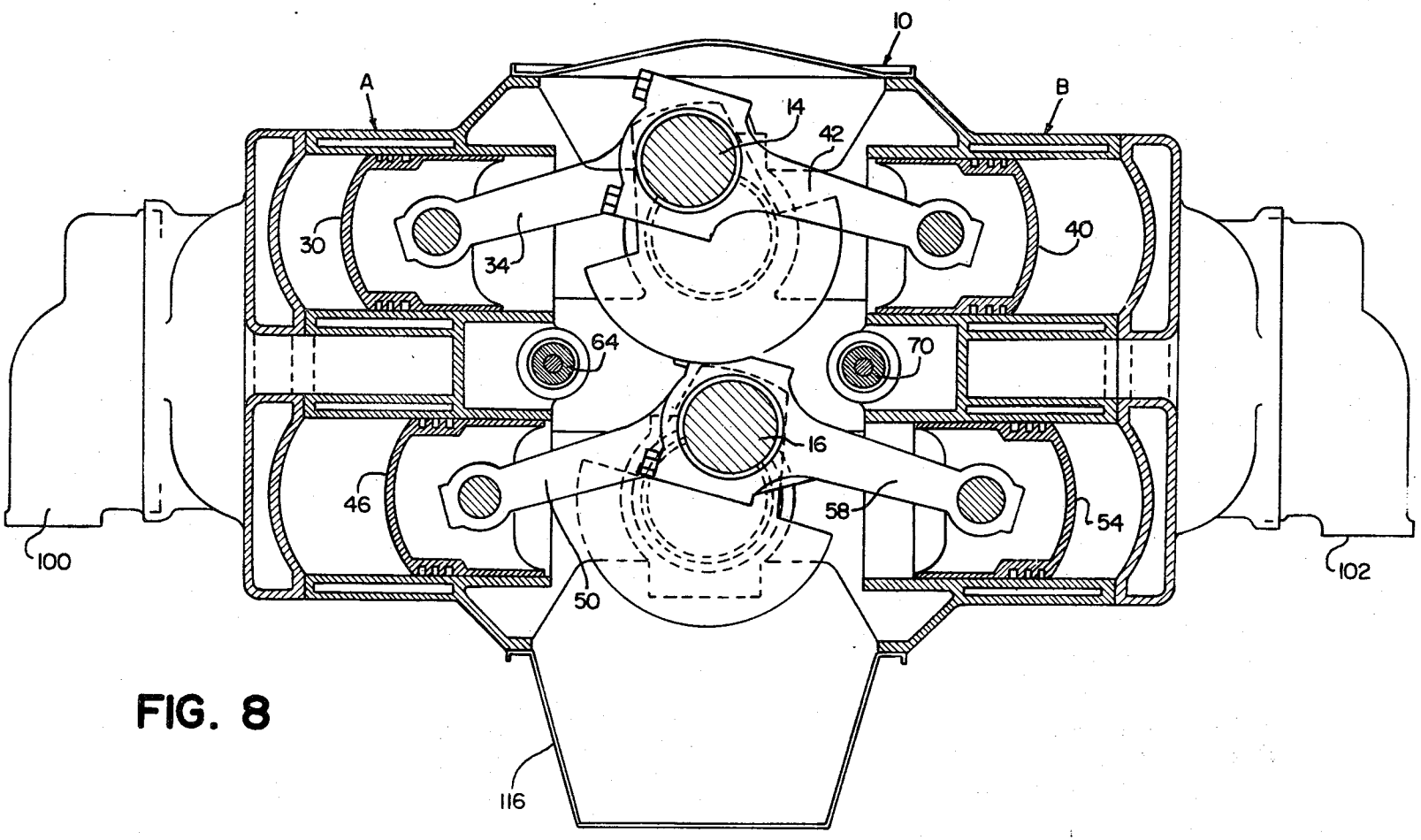
FIG. 8 is a cross sectional view, taken along line 8—8 on FIG. 3, looking in the direction of the arrows.
Figure 9:
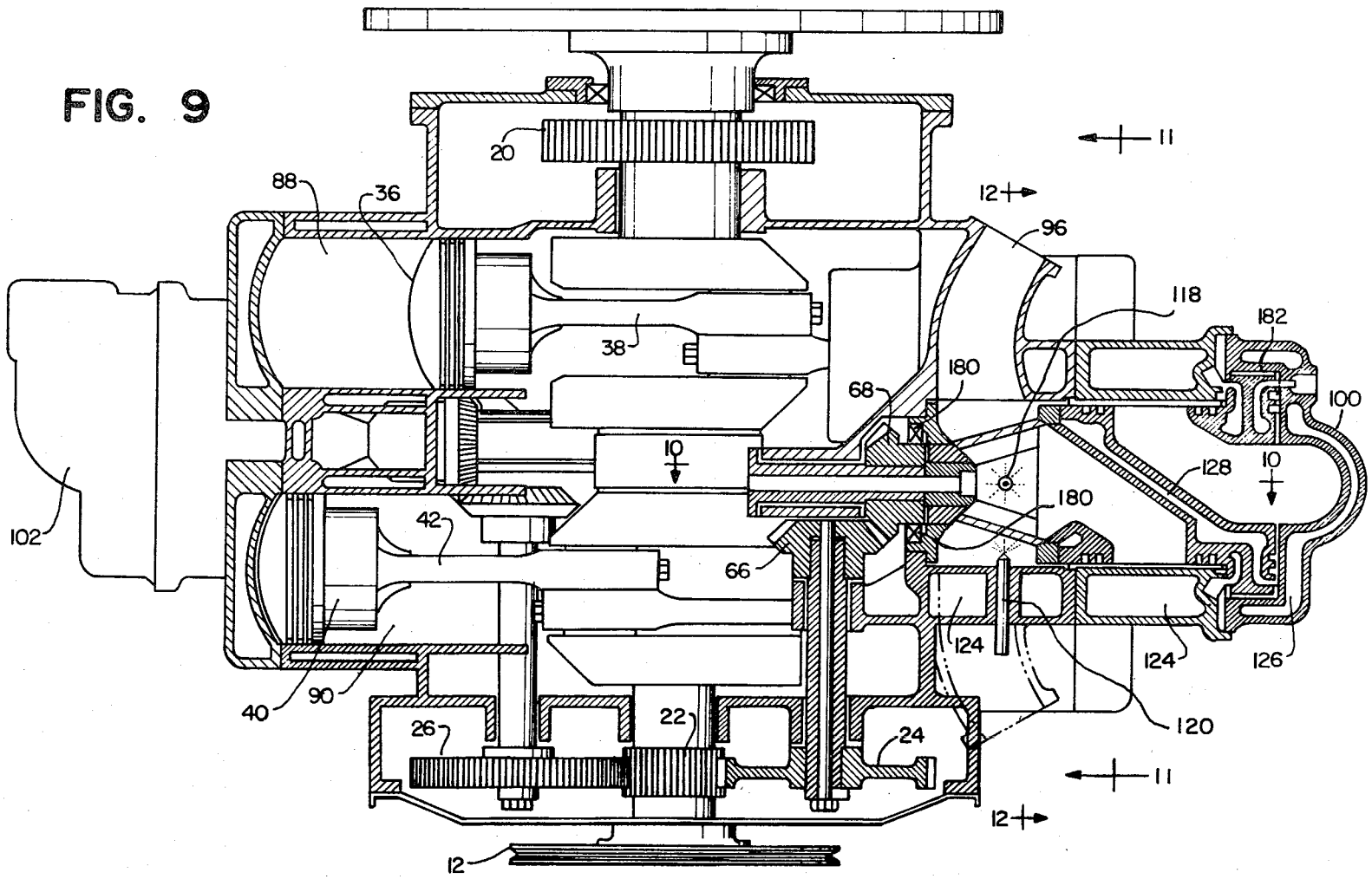
FIG. 9 is a cross sectional view taken along line 9—9 on FIG. 2 looking in the direction of the arrows.

As best seen in FIGS. 6*a* and 6*b*, the left bank of cylinders A comprises the upper cylinders 76, 78 within which the upper pistons 28, 30 are respectively reciprocal in well known manner, and the lower cylinders 80, 82 within which the lower pistons 44, 46 are similarly respective reciprocal. Similarly, the right bank B of cylinders comprises the upper cylinders 84, 86 within which the upper pistons 36, 40 are reciprocal and the lower cylinders 88, 90 within which the lower pistons 52, 54 are respectively reciprocal, in the known manner. Accordingly, the left bank of pistons 28, 30, 44 and 46 and the right bank of pistons 36, 40, 52 and 54 cooperate to rotate the upper and lower crank shafts 14, 16 in synchronism. In view of the common connections of opposed piston rods on common cranks, there is presented an inherently balanced arrangement. Power can be conventionally taken from either crankshaft 14, 16, depending upon the orientation of the engine. Also, the twin crankshaft design makes it possible to take power from either end of the engine 10.

Referring now to FIGS. 1, 2, 3 and 4, the engine 10 comprises generally a block 112 within which the cylinders 76, 78, 80, 82, 84, 86, 88, 90 (FIGS. 6*a* and 6*b*) are bored or otherwise provided in known manner and within which the valves 60, 62, are respectively rotated in synchronism. Exhaust manifolds 100, 102 are bolted or are otherwise affixed to the engine block 112 in known manner to receive the spent exhaust gases from the rotary valves 60, 62 for discharge from the engine. A plurality of air inlets 92, 94, 96 and 98 respectively feed combustion air to the air-fuel inlet side of the rotary valves 60, 62 for introduction into the cylinders 76, 78, 80, 82 and 84, 86, 88, 90 in the manner hereinafter more fully set forth. To provide access to the various cylinders, cylinder heads 104, 106, 108, 110, 104', 106' may be affixed to the engine block 112 in known manner, for example, by employing a plurality of machine bolts or screws 114. A usual oil pan 116 affixes below the engine block 112 in the usual manner for storage of a supply of lubricating oil (not illustrated) for usual engine lubrication purposes.

Figure 10:
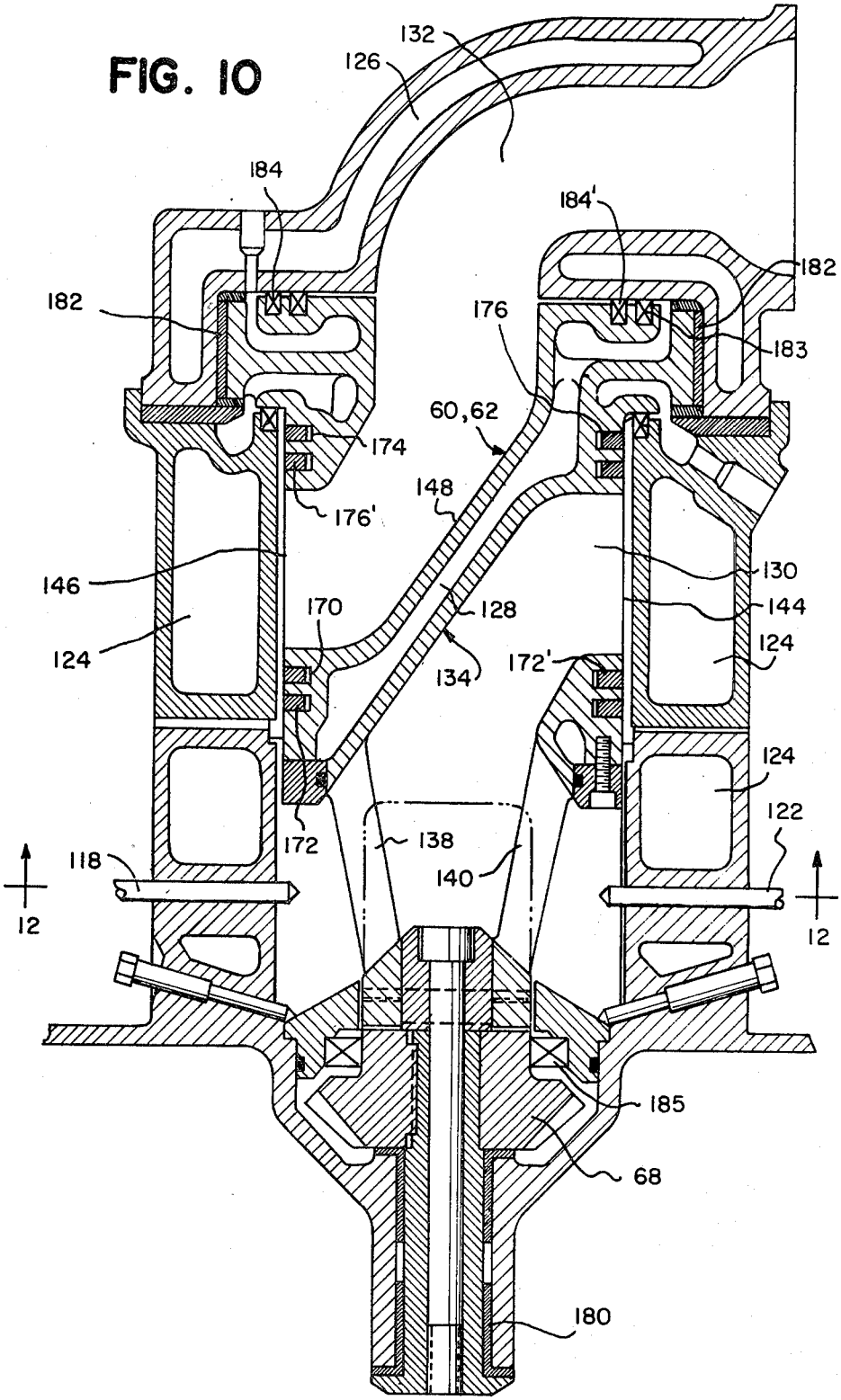
FIG. 10 is an enlarged, cross sectional view of the rotary valve, taken along line 10—10 on FIG. 9.
Figure 12:
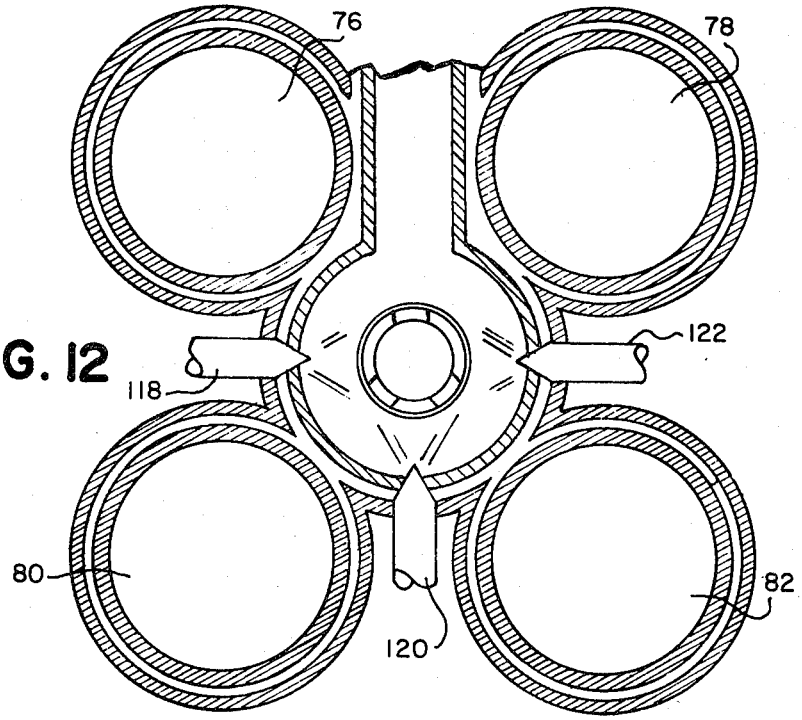
FIG. 12 is an enlarged, cross sectional view taken along line 12—12 on FIG. 9, looking in the direction of the arrows.
Figure 13:
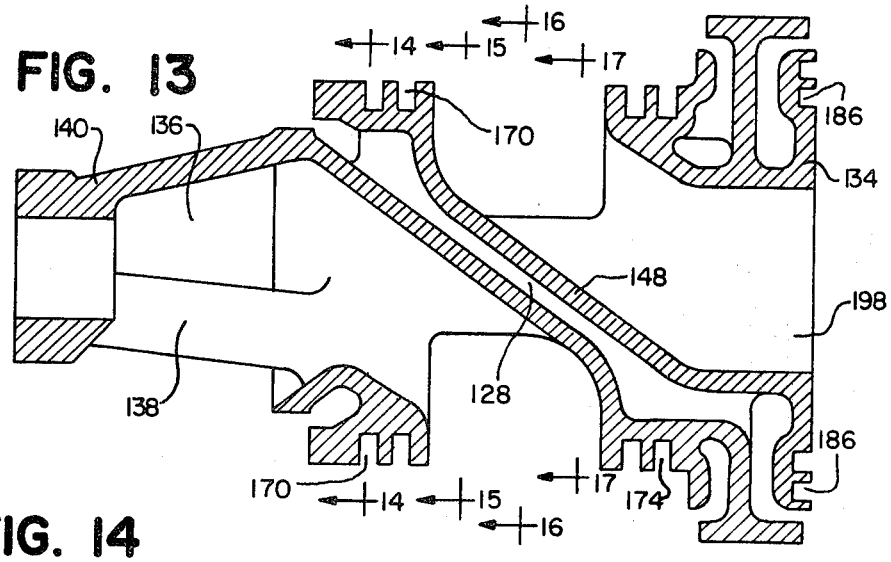
FIG. 13 is an enlarged, sectional view through the rotary valve casting.
Figure 14:
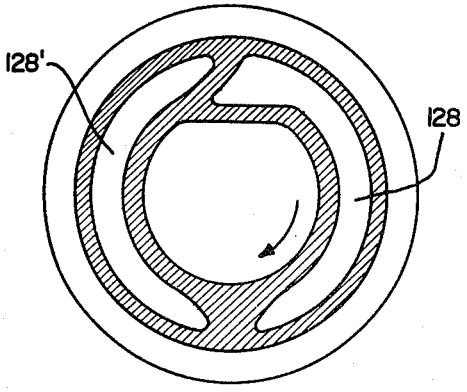
FIG. 14 is a cross sectional view taken along line 14—14, on FIG. 13, looking in the direction of the arrows.
Figure 15:
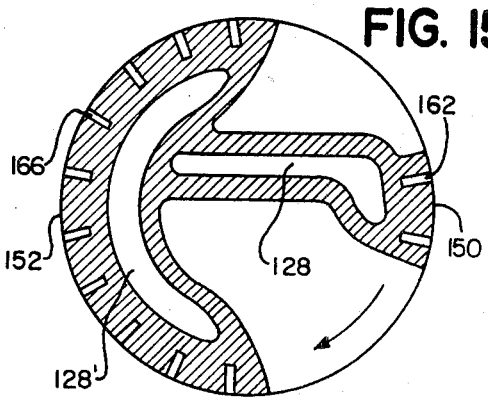
FIG. 15 is a cross sectional view taken along line 15—15 on FIG. 13, looking in the direction of the arrows.
Figure 16:
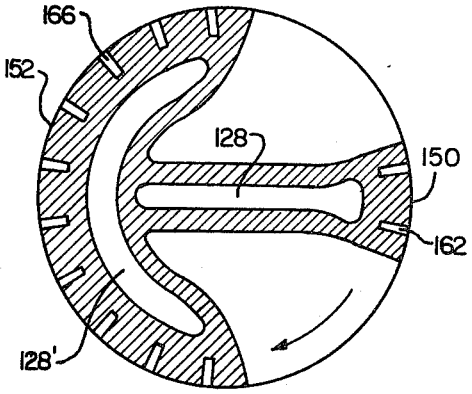
FIG. 16 is a cross sectional view taken along line 16—16 on FIG. 13, looking in the direction of the arrows.
Figure 17:
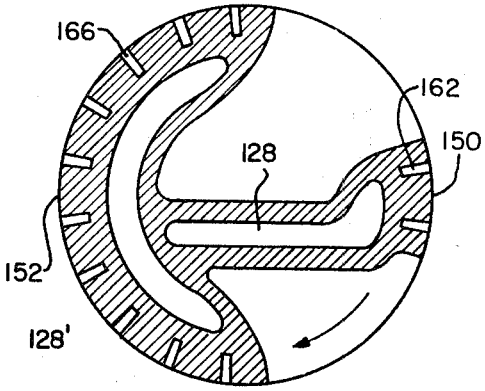
FIG. 17 is cross sectional view taken along line 17—17 on FIG. 13, looking in the direction of the arrows.

In the embodiment illustrated, fuel injectors 118, 120, 122 (FIGS. 10 and 12) are illustrated. However, it should be noted that it is possible to use a conventional carburetor for operation of the engine instead of the fuel injection system if a carbureted system is desirable for certain specialized commercial or industrial applications or fuel could be injected directly into each cylinder. In the event a gaseous fuel is to be employed, conventional spark plugs (not shown) would be required in each cylinder, which spark plugs could be readily provided in known manner by those skilled in the art. Suitable block coolant passages 124, manifold coolant passages 126 and valve coolant passages 128 are provided in known manner as may be required in accordance with usual liquid cooled engine design practices. It should be noted that the invention is not limited, however, to liquid cooled designs, and the rotary valve of the present invention could be equally applicable for use in an air cooled engine by providing suitably designed cooling air fins at strategic locations, all in manner well known to those skilled in the art.

Referring now to FIGS. 18–21, each rotary valve 60, 62 is similarly formed and includes generally a cylindrical body 134 having juxtaposed air-fuel and exhaust gas passages 130, 132 formed therein. The air-fuel mixture enters the inlet to the air-fuel passage 130 through the spaces 136 defined between the plurality of supporting arms 138, 140, 142, as best seen in FIG. 18. The air-fuel mixture travels through the air-fuel passage 130 and exits the valve 60 at the air-fuel port 144 for introduction in turn respectively to the gas passage or cylinder port 154, 156, 158, 160, (FIG. 11) of the cylinders 76, 78, 80, 82 of bank A or the cylinders 84, 86, 88, 90 (FIG. 6*a* and FIG. 6*b*) comprising bank B. Exhaust gases from the various cylinders enter the exhaust gas passage 132 in turn through the gas passages 154, 156, 158, 160, and the circularly aligned exhaust gas port 146 as each valve 60, 62 is rotated. See FIGS. 10, 11 and 18. A separator 148 which preferably is angled or skewed relative to the longitudinal axis of the rotary valve defines the air-fuel passage 130 from the exhaust gas passage 132. The separator 148 preferably includes a coolant passage 128 (FIG. 19) for interior exhaust cooling purposes inasmuch as the hot exhaust gases impinge directly upon the separator 148 as the gases are directed from each cylinder in turn upon rotation of the valve 60. Alternately, the separator 148 could be fabricated of a heat resistant material, such as ceramic, to thereby eliminate the need for providing a coolant passage. Also a shield usually called an exhaust port liner (not shown) could line the passage 132.

Figure 11:
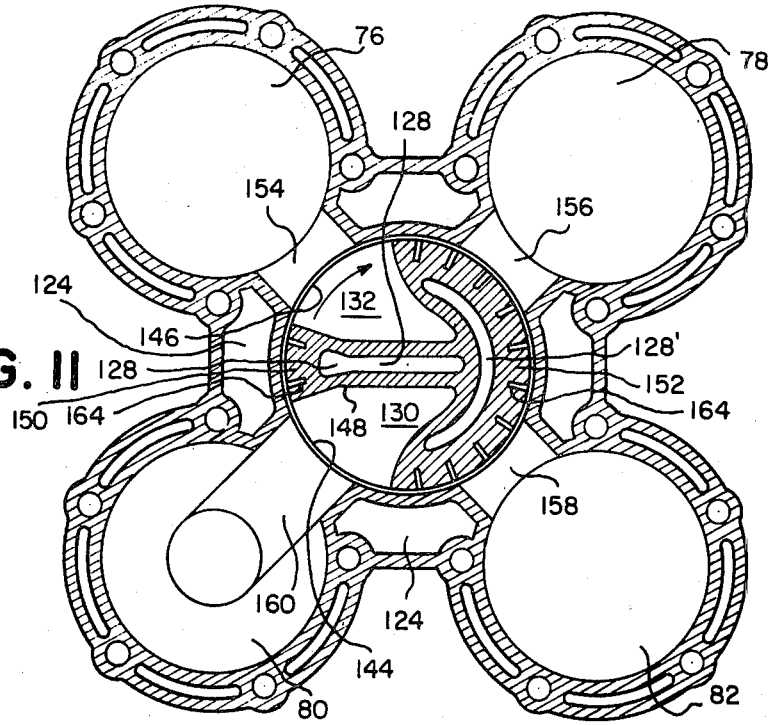
FIG. 11 is an enlarged, cross sectional view taken along line 11—11 on FIG. 9, looking in the direction of the arrows.

The peripheral extent of the air-fuel passage 130 and exhaust gas passage 132 is defined by the common separator 148, which includes a relatively narrow arcuate sealing section 150 and an opposite, larger sealing section 152, which section preferably also is provided with a suitable coolant passage 128'. As best seen in FIG. 11, the narrow arcuate sealing section 150 extends through an arc that is less than the arcuate distance between any of the circularly adjacent cylinder gas passages 154, 156, 158, 160. The larger peripheral sealing section 152 extends through a circular arc that is greater than the overall distance between the gas ports 154, 156, 158, 160 of any pair of circularly adjacent cylinders, whereby the gas ports, for example gas ports 156, 158 of two cylinders will be entirely sealed by the sealing section 152 when the gas ports, for example gas ports 156, 160 of the other two cylinders in the bank are exposed and in fluid communication respectively with the air-fuel passage 130 and the exhaust gas passage 132. Still referring to FIG. 11, it will be seen that the dimensions of the narrow and large sealing sections 150, 152 are particularly designed to define that the arcuate peripheral extent of the air-fuel port 144 and the exhaust gas port 146 is greater than the arcuate extent of any of the cylinder gas passages 154, 156, 158, 160 at the interface therebetween.

As best seen in FIGS. 17, 18, 19 and 21, the narrow sealing section 150 is provided with a plurality of longitudinal aligned notches or grooves 162 within which are positioned longitudinal seal means or seals 164, which seals function to seal one side of the gas passage or port to a cylinder from the next circularly adjacent cylinder gas passage or port. Similarly, the larger sealing section 152 is cast, milled or otherwise formed to provide a plurality of circularly spaced, longitudinally aligned, notches 166 for respectively seating therein a plurality of similar, longitudinal seal means or seals 168. Thus the plurality of longitudinal seals 168 cooperate to seal the other sides of the gas passages to provide complete peripheral sealing of the valve 60 as it is rotated relative to the stationary banks of cylinders 76, 78, 80, 82 and 84, 86, 88, 90. See FIGS. *6a* and *6b*.

The valve body 134 is provided with a pair of lower, longitudinally spaced, grooves or circular notches 170 (FIG. 10) within which are positioned respectively the lower, circular, sealing rings 172, 172'. See FIGS. 18 and 21. The seal rings 172, 172' define and seal one end of the air-fuel port 144 and the exhaust gas port 146. Still referring to FIGS. 18 and 21, it will be observed that the valve body 134 is additionally provided with an upper pair of longitudinally spaced, circular notches 174 within which the pair of upper circular sealing rings 176, 176' are positioned. The upper sealing rings 176, 176' in corporation with the lower sealing rings 172, 172' seal the other ends of the air fuel port 144 and the exhaust gas port 146 to prevent leakage thereabout. Accordingly, all of the exhaust gases which enter a rotary valve 60, 62 through the exhaust gas inlet port 146 travel through the exhaust gas passage 132 without leakage and exit through the valve outlet 198 for delivery to the exhaust manifolds 100, 102 (FIG. 1).

Figure 21:
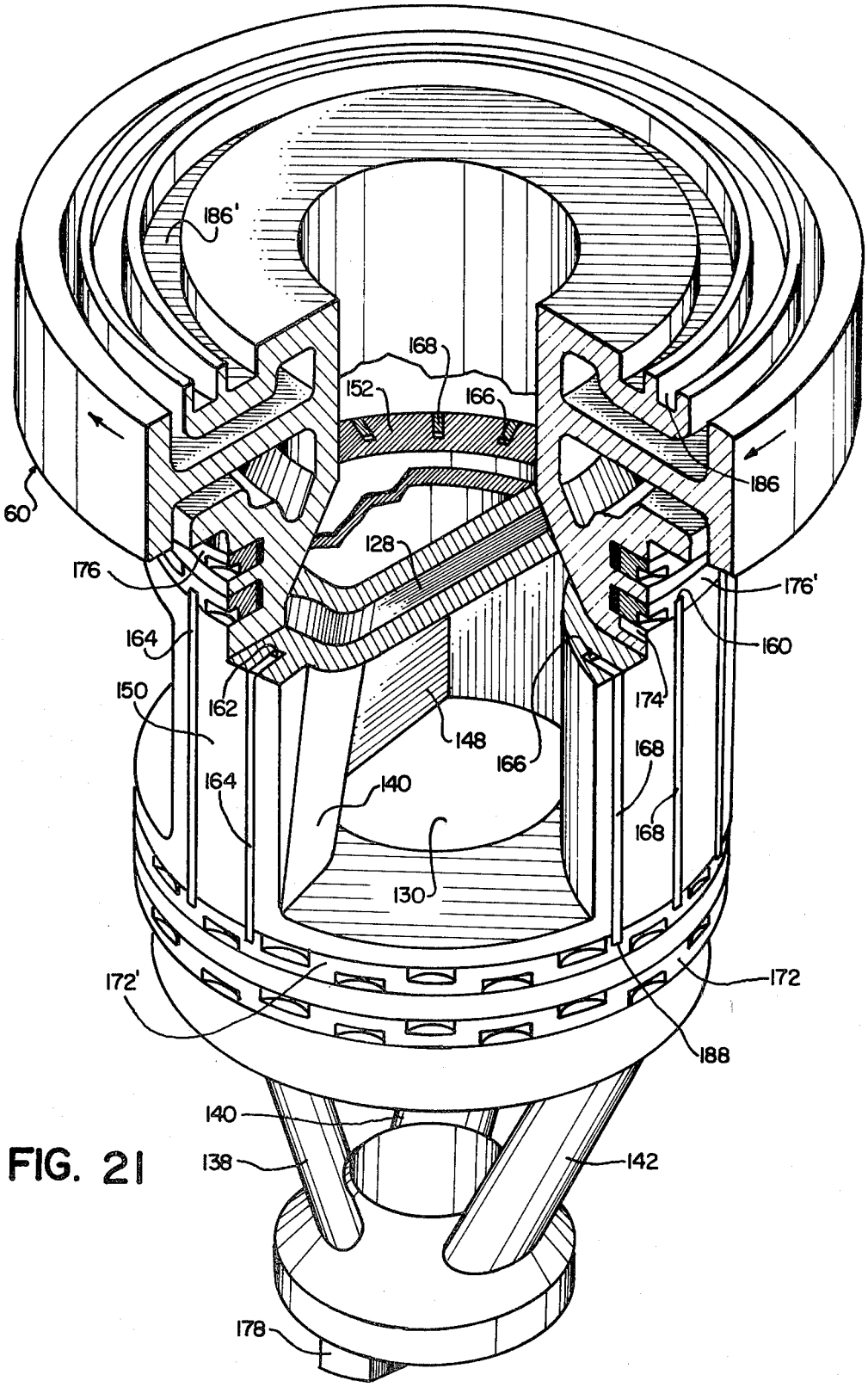
FIG. 21 is an enlarged, perspective, quarter sectional view of the rotary valve of FIG. 18.
Figure 22:
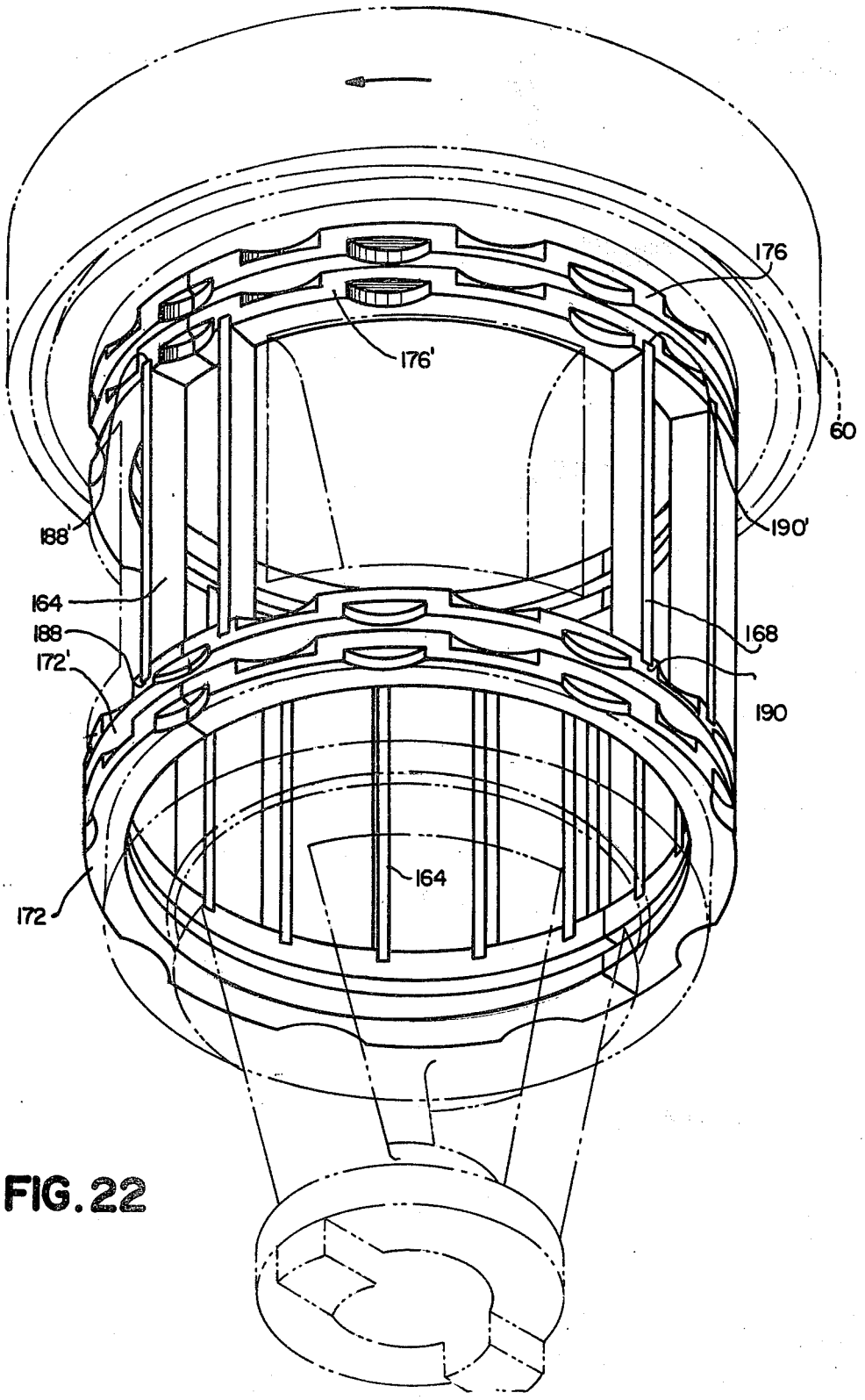
FIG. 22 is an enlarged, perspective view of the rotary valve of FIG. 18, showing the circular combustion seal rings and the axial combustion seals in full lines and the remainder of the valve in phantom lines for purposes of association.
Figure 23:
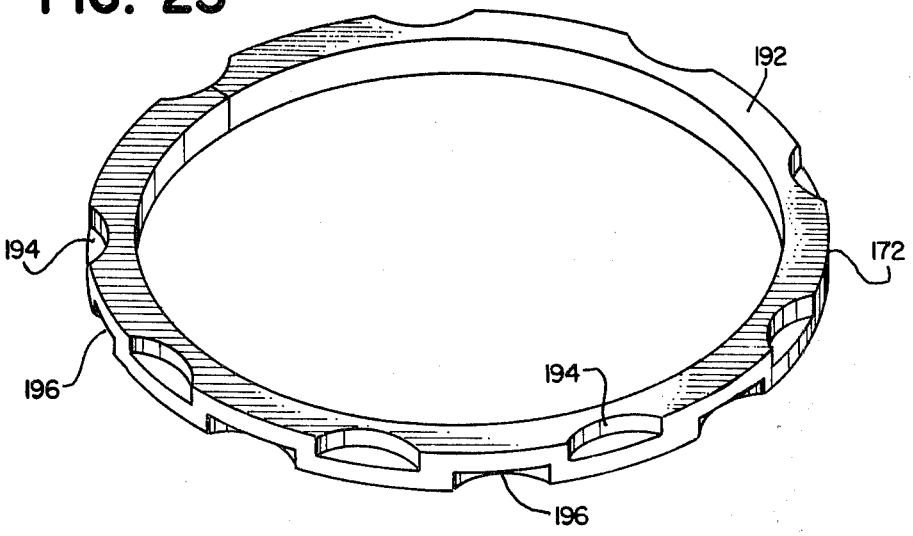
FIG. 23 is a perspective view of a circular seal ring.
Figure 24:
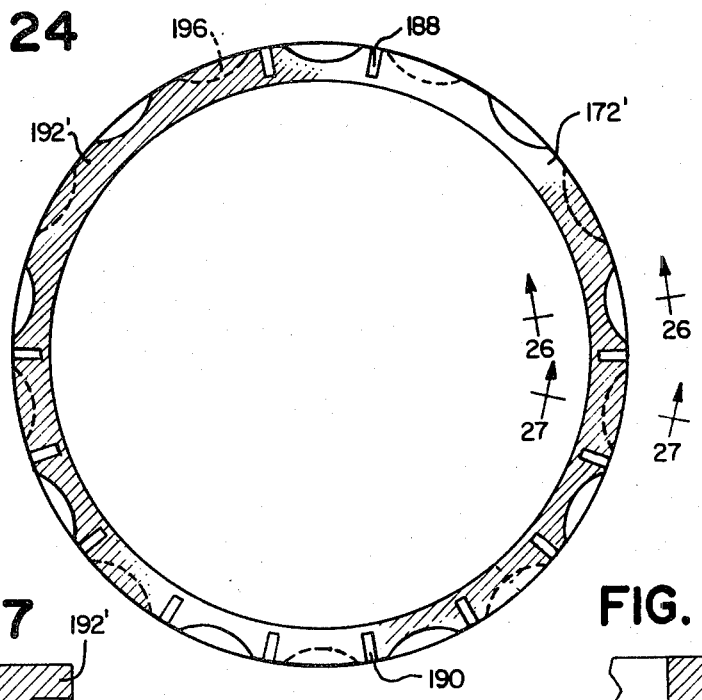
FIG. 24 is a top plan view of the circular seal ring of FIG. 23.
Figure 27:
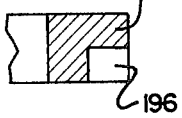
FIG. 27 is a cross sectional view taken along line 27—27 on FIG. 24, looking in the direction of the arrows.
Figure 26:
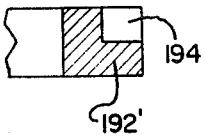
FIG. 26 is a cross sectional view taken along line 26—26 on FIG. 24, looking in the direction of the arrows.
Figure 25:
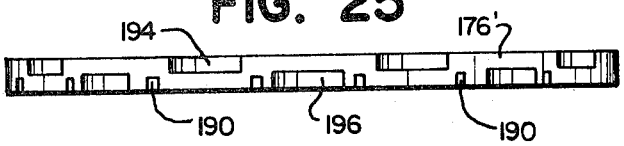
FIG. 25 is a side elevational view of the circular seal ring of FIG. 23.

Referring now to FIGS. 18, 21 and 22, it will be seen that the circular seal rings 172, 172', 176, 176' are all substantially identical and are positioned within the respective circular, peripheral notches 170, 174. The facing seals 172', 176' of the upper and lower pairs of circular sealing rings 172, 172' and 176, 176' include a plurality of peripheral notches 188, 188' which are positioned and formed to receive respectively therein the ends of the plurality of longitudinally aligned seals 164. Similarly, a second plurality of notches 190, 190' receive respectively the ends of the other longitudinally aligned seals 168. The outer lower and upper seal rings 172, 176 are similar to the inner seal rings 172', 176' with the exception that the radial notches 188, 188', 190, 190' are completely eliminated.

Turning now to FIGS. 23–27, the lower seal rings 172, 172' are illustrated. It will be appreciated that the upper circular seal rings 176, 176' are similar in construction and need not be further described in detail. Each seal ring 172, 172' is formed of suitable metallic or other material capable of withstanding the heat of combustion normally encountered within an internal combustion engine of the type set forth. Each ring is formed with an annular, flat body 192, 192' having a plurality of circularly spaced upper arcuate recesses 194 and a plurality of alternately positioned, circularly spaced, lower, arcuately configured recesses 196. The upper and lower recesses 194, 196 extend in depth at least one half the thickness of the sealing ring annular body 192, 192', and preferably extend slightly more than one half the thickness, to provide an overlapping, rotary sealing engagement.

In operation, the respective associated bevel gears 68, 74 (FIG. 5) of the rotary valves 60, 62 are powered in synchronism by their respective mating bevel gears 66 and 72 to impose rotative forces at the integral, valve bottom keys 178 (FIGS. 18 and 21). Suitable lower bearings 180 and upper bearings 182 are provided (FIG. 10) to facilitate valve rotation through the first and second rotary valve timing gears 24, 26. As best seen in FIG. 21, upper, circular, concentric notches or grooves 186, 186' can be cast, milled or otherwise provided in the rotary valve body 134 for positioning therein of the upper circular seals 184, 184'. A lower seal 185 is provided to seal the inlet end of the valves 60, 62.

Although the present invention has been described with reference to the particular, embodiments herein set forth, it is understood that the present disclosure has been made only by way of example and numerous changes in the details of construction may be resorted to without departing from the spirit and scope of the invention. Thus, the scope of the invention should not be limited by the foregoing specification, but rather only by the scope of the claims appended hereto.

What is claimed is:

1. A rotary valve for an internal combustion engine comprising a generally cylindrical housing, the housing being adapted for rotation about an axis, the housing comprising a peripherally positioned narrow sealing section and a peripherally positioned large sealing section;

an air-fuel passage provided in the rotary valve housing, the air-fuel passage extending from an air-fuel inlet in the valve to an air-fuel port;

an exhaust gas passage provided in the rotary valve housing, the exhaust gas passage extending from an exhaust gas port to an exhaust gas outlet;

first axial seal means between the air-fuel port and the exhaust gas port to prevent flow of gas between said ports, the first axial seal means being positioned within the narrow sealing section;

second axial seal means between the air-fuel port and the exhaust gas port to prevent gas flow between said ports, the second axial seal means being positioned within the large sealing section;

third seal means extending circumferentially about the housing at one longitudinal side of the air-fuel port and the exhaust gas port to prevent longitudinal gas flow exteriorly of the housing, the third seal means comprising a pair of circular rings;

fourth seal means extending circumferentially about the housing adjacent the other longitudinal side of the air-fuel port and the exhaust gas port to prevent longitudinal gas flow exteriorly of the housing, the fourth seal means comprising a second pair of circular seal rings;

at least one of the seal rings being provided with a plurality of arcuate notches.

2. The rotary valve of claim 1 wherein the said at least one seal ring is annular in configuration and compises a top surface and a bottom surface, at least some of the arcuate notches extending to the top surface.

3. The rotary valve of claim 2 wherein at least some of the arcuate notches extend at least one-half the distance between the top surface and the bottom surface.

4. The rotary valve of claim 2 wherein others of said arcuate notches extend to the said bottom surface.

5. The rotary valve of claim 4 wherein the top extending notches circularly alternate with the bottom extending notches.

6. The rotary valve of claim 2 wherein the said seal ring is provided with at least one radially oriented notch.

7. The rotary valve of claim 6 wherein a portion of first axial seal means is seated within the radially oriented notch.

8. In a rotary valve for feeding an air fuel mixture to the ports of a plurality of cylinders in an internal combustion engine and for exhausting exhaust gases from the ports, the combination of a housing adapted for rotation within the engine;

inlet means at one end of the housing to admit an air-fuel mixture into the valve;

outlet means at the other end of the housing to expel exhaust gases from the housing;

an air-fuel port provided in the periphery of the housing to direct an air-fuel mixture from the valve and into the cylinder ports;

an exhaust port provided in the periphery of the housing to admit exhaust gases from the cylinder ports, the exhaust port being offset from the air-fuel port by an angle of less than one hundred and eighty degrees;

an air-fuel passage interconnecting the exhaust port with the outlet means;

sealing means in the periphery of the housing to seal the air-fuel port and the exhaust port as the rotary valve rotated, the air-fuel port and the exhaust port defining therebetween a narrow, arcuate, sealing section and a larger, arcuate sealing section, the sealing means comprising first longitudinally extending seals positioned in the narrow sealing section, second longitudinally extending seals positioned in the larger sealing section, a third circular seal positioned in the housing adjacent one longitudinal end of the air-fuel port and exhaust port and a fourth circular seal positioned in the housing adjacent to the other longitudinal ends of the air-fuel port and exhaust port;

and wherein at least some of the circular seals are provided with peripherally positioned notches.

9. The rotary valve of claim 8, wherein at least one of the narrow sealing section and the larger sealing section is provided with a coolant passage.

10. The rotary valve of claim 8 wherein end portions of at least some of the longitudinally extending seals terminate at portions of the third and fourth circular seals.

11. The rotary valve of claim 8 wherein the first ends of the longitudinally extending seals terminate at the third circular seal and the other ends of the longitudinally extending seals terminate at the fourth circular seal.

12. The rotary valve of claim 8 wherein the notches are arcuate in configuration.

13. The rotary valve of claim 8 wherein the notches extend at least half way through the thickness of the circular seal.

14. The rotary valve of claim 8 wherein the seal includes a first flat surface and a spaced, second flat surface, the first and second surfaces defining a circular body therebetween.

15. The rotary valve of claim 14 wherein some of the notches extend into the body from the first surface.

16. The rotary valve of claim 14 wherein some of the notches extend into the body from the first surface and other of the notches extend into the body from the second surface.

17. The rotary valve of claim 16 wherein the first surface notches circularly alternate with second surface notches.

* * * * *